US006048242A

United States Patent [19]

Reinhardt et al.

[11] Patent Number: 6,048,242

[45] Date of Patent: Apr. 11, 2000

[54] FABRICATION OF TRAVELING WAVETUBE BARRELS USING PRECISION TRACK FORMING

[75] Inventors: Nicholas Reinhardt, Lexington, Mass.; George F. Kirkman, Palos Verdes Estates, Calif.

[73] Assignee: Hughes Electronics Corporation, El Sēgundo, Calif.

[21] Appl. No.: 09/295,702

[22] Filed: Apr. 21, 1999

[51] Int. Cl.[7] ..... H01J 25/34

[52] U.S. Cl. ..... 445/23

[58] Field of Search ..... 445/23; 315/3.5

[56] References Cited

U.S. PATENT DOCUMENTS 4,278,914 7/1981 Harper ..... 315/3.5

*Primary Examiner*—Kenneth J. Ramsey

*Attorney, Agent, or Firm*—Bradley K. Lortz; Michael W. Sales; Viji D. Duraiswamy Vijayalakshmi (Viji)

[57] ABSTRACT

The inner surface of a barrel for a traveling wave tube is formed with a set of tracks extending parallel to the longitudinal axis of the barrel. The rods supporting the traveling wave tube circuit assembly are supported in the tracks. The tracks are formed by forcing a tool having track-forming elements through the barrel, or a succession of ever-larger tools may be used to first form and then gradually enlarge the tracks.

15 Claims, 3 Drawing Sheets

FABRICATION OF TRAVELING WAVETUBE BARRELS USING PRECISION TRACK FORMING

BACKGROUND OF THE INVENTION

This invention relates to traveling wave tube amplifiers, and, more particularly, to the method of fabricating the barrel of traveling wave tubes and of supporting the traveling wave tube circuit assembly within the barrel.

Traveling wave tubes are used to amplify signals in microwave systems. For example, traveling wave tubes may be provided in satellite communications systems to amplify the signals received from earth before their retransmission back to earth.

The traveling wave tube generally includes an input coupling element, an output coupling element, and a traveling wave circuit therebetween. The traveling wave circuit consists of a wire helix or other slow wave structure interacting with an electron beam that is confined within a barrel. The barrel provides a vacuum envelope and support structure for the traveling wave tube circuit. The barrel is typically made of a thermally conductive metal such as annealed copper, although other materials may be used. The wire helix is supported by dielectric rods from the inner wall of the bore of the barrel. The dielectric rods serve to position the wire helix, and also to conduct heat from the wire helix to the barrel, where the heat is dissipated. A properly controlled electron current flowing through the interior passage of the helix transfers energy to the microwave signal flowing in the wire helix, thereby amplifying the microwave signal.

In a typical manufacturing operation, the inner bore of the barrel is sized to a cylindrical shape within close tolerances. Sizing may be accomplished by honing, reaming, or drilling. The barrel is thereafter heated to elevated temperature to expand it radially, a traveling wave circuit assembly including the dielectric rods and the wire helix is placed into the barrel, and the barrel is cooled to shrink it into contact with the dielectric rods. The traveling wave circuit is supported from the barrel by a tight interference fit.

While operable and widely used, this technique requires a large number of steps and careful process control to prevent contamination of the final assembly by chips, powder, chemicals and the like produced or used during the sizing operation. The sizing operation is conducted in a machine shop, and the assembly is performed in a clean room. The sized barrel must be moved between the various locations, inspected multiple times, and carefully cleaned each time it is to enter the clean room. All of these steps are time consuming and lead to a substantially increased cost of manufacture.

There is a need for an improved approach to the fabrication and assembly of traveling wave tubes. The present invention fulfills this need, and further provides related advantages.

SUMMARY OF THE INVENTION

The present invention provides a traveling wave tube and a method of fabricating a traveling wave tube barrel. The traveling wave tube barrel receives and precisely positions the rods of the traveling wave tube circuit assembly. The fabrication approach for processing the inside surface of the traveling wave tube barrel does not generate chips, powder, or other contaminants, and can be performed in a clean room. Many cleaning and precision sizing operations, required in prior approaches to fabricating the traveling wave tube barrel, are not necessary. The fabrication procedure is thereby substantially simplified and shortened, and the cost of fabrication is reduced.

In accordance with the invention, a method of fabricating a traveling wave tube comprises the steps of providing a hollow cylindrical barrel having a longitudinal axis and having a bore defined by an inner wall with an inside diameter, and providing an elongated tool. The tool includes a tool body, and at least two track-forming elements extending outwardly from the tool body. The at least two track-forming elements have a circumscribed maximum diameter greater than the inside diameter of the hollow cylindrical barrel. Preferably but not necessarily, the at least two track-forming elements are positioned symmetrically about the tool body. Desirably, the track-forming elements are elongated parallel to a direction of elongation of the tool in order to serve as "keels" to constrain the track-forming elements to move in a straight line parallel to the longitudinal axis of the barrel. The tool is forced through the bore in the direction parallel to the longitudinal axis to define a track in the inner wall of the hollow barrel for each of the at least two track-forming elements. The method further includes assembling a traveling wave tube circuit assembly inside the bore of the barrel. The traveling wave tube circuit assembly includes at least two rods, one supported in each of the at least two tracks and extending parallel to the longitudinal axis. To produce particularly deep tracks or for particular materials of construction of the barrel, two or more tools of progressively larger circumscribed maximum diameters may be passed through the interior of the barrel, each succeeding tool enlarging and deepening the tracks further.

The present approach produces a set of circumferentially positioned tracks extending parallel to the longitudinal axis of the traveling wave tube barrel, extending outwardly from the bore of the barrel. The sides and bottoms of the tracks are configured to hold the rods of the traveling wave tube circuit assembly in place at the desired location within the traveling wave tube barrel. The expensive sizing operation of the conventional approach is thereby eliminated. In the present approach, the tracks are formed by metal displacement, not metal cutting or removal, so that there are no chips or other solid residue of the track-forming operation. The track formation may be performed with or without lubricant, the latter preferred because it avoids the necessity to remove the lubricant. The track formation may be performed at room temperature, or at elevated or reduced temperature, according to the requirements of the particular metal being worked.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

BRIEF DESCRIPTION OF THE DRAWINGS

FIGS. 5A–5F illustrate some tools operable with the present invention, wherein FIGS. 5A–5B illustrate a sliding tool in end and side elevational partial views, respectively; FIGS. 5C–5D illustrate a ball-supported rolling tool in end and side elevational partial views, respectively; and FIGS. 5E–5F illustrate a wheel-supported rolling tool in end and side elevational partial views, respectively.

DETAILED DESCRIPTION OF THE INVENTION

Figure 1:
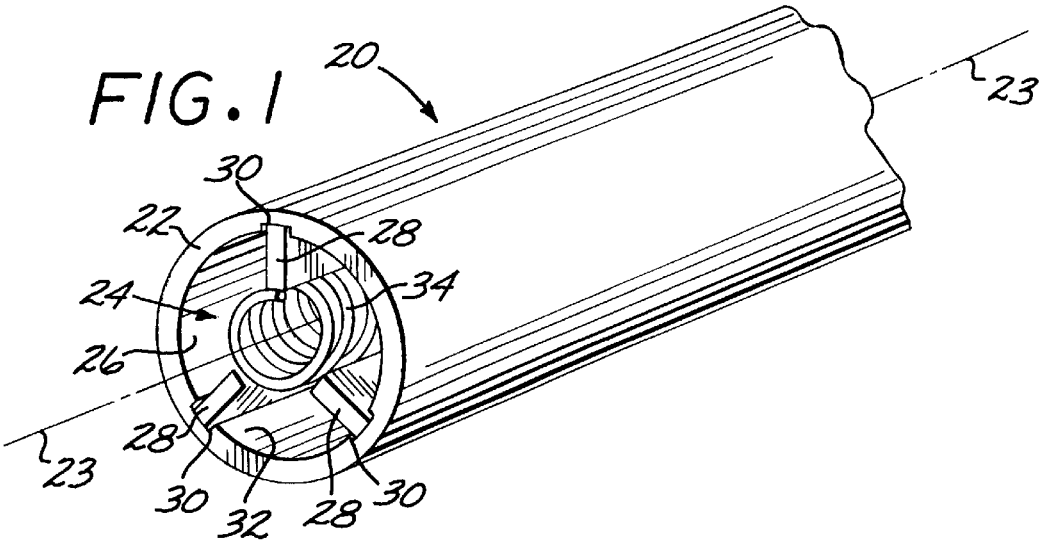
FIG. 1 is a perspective view of a traveling wave tube barrel assembly according to the present invention.

FIG. 1 depicts a traveling wave tube assembly 20, comprising a hollow traveling wave tube barrel 22 elongated along a longitudinal axis 23. A traveling wave tube circuit assembly 24 is mounted within a bore 26 of the traveling wave tube barrel 22. The traveling wave tube barrel 22 is typically made of a good thermal conductor, such as soft (annealed) copper, but other materials of construction may also be used. The traveling wave tube circuit assembly 24 includes at least two, and here depicted as three, rods 28 supported in tracks 30 in the inner wall 32 of the traveling wave tube barrel 22, and a metal helix 34 supported by the rods 28. The general features of such traveling wave tube assemblies, except as discussed further below, are well known in the art.

Figure 2:
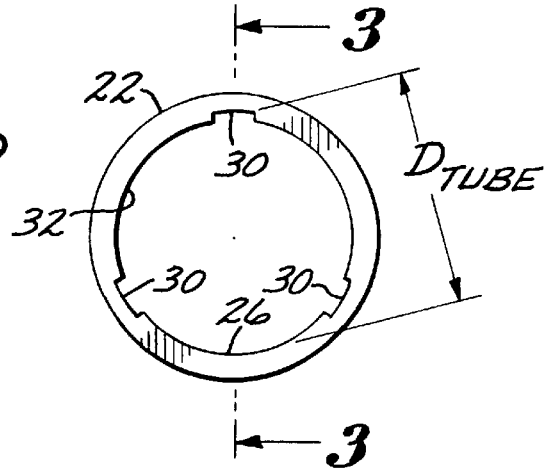
FIG. 2 is an end elevational view of the traveling wave tube barrel of FIG. 1, without the traveling wave tube circuit assembly.
Figure 3:
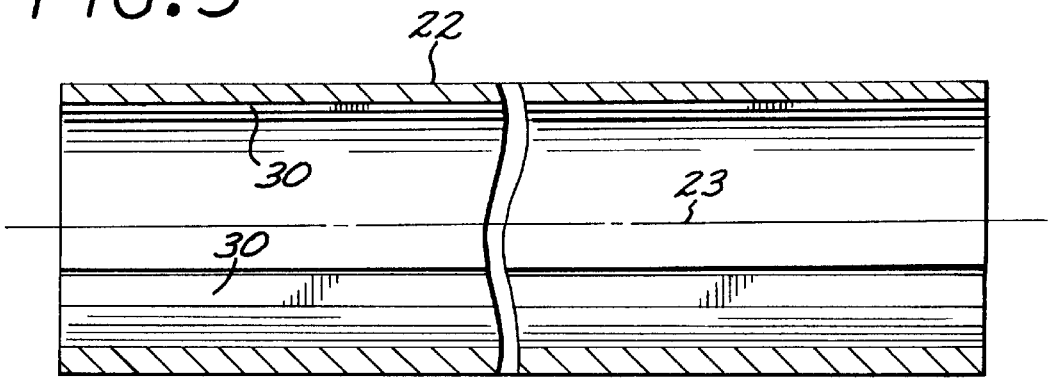
FIG. 3 is a side sectional view of the traveling wave tube barrel, taken along line 3—3 of FIG. 2, without the traveling wave tube circuit assembly.

FIGS. 2–3 illustrate the traveling wave tube barrel 22 in greater detail, with the traveling wave tube circuit assembly 24 removed for clarity. In this preferred embodiment, there are three of the tracks 30 symmetrically spaced equidistantly around the inner wall 32 of the bore 26, but in other cases the tracks may be asymmetrically positioned around the inner wall. Three tracks provide a secure triangular mounting for the helix 34, but as few as two or more than three tracks may be used instead.

Figure 4:
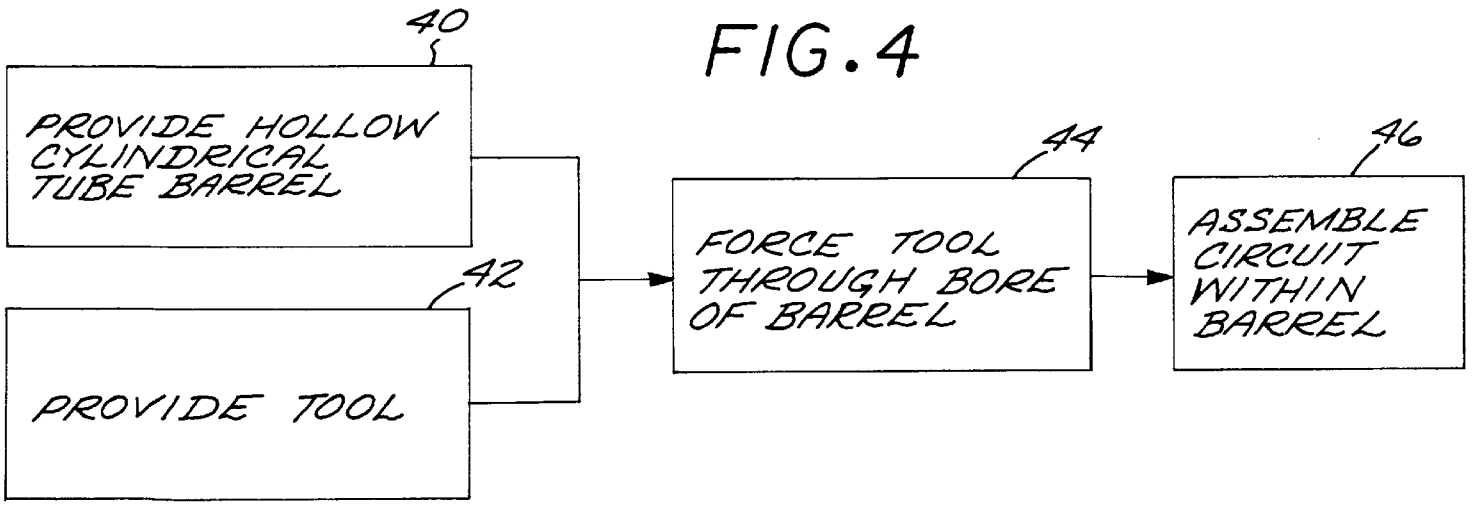
FIG. 4 is a block flow diagram of an approach for fabricating the traveling wave tube of FIG. 1.

FIG. 4 illustrates a preferred approach for fabricating the traveling wave tube barrel 22 of FIGS. 1–3. A hollow cylindrical tube is provided, numeral 40. The tube has an inner diameter of $D_{tube}$. The present approach is contrasted with the conventional approach for the structure of the traveling wave tube. In the conventional approach, the bore is precisely sized, usually to a diametral tolerance of less than 0.0002 inch, as by honing, reaming, or drilling, to provide a smooth, continuous inner wall of constant diameter. The sizing operation involves metal cutting, resulting in chips, lubricant, and other contaminants which require many cleaning operations. The precise sizing required of conventional barrels increases the difficulty of manufacture and cost of the barrel, and results in reduced yields of acceptable barrels. The precision sizing in the conventional approach is performed in a machine shop, and the barrel must be carefully cleaned before being introduced into a clean room for further assembly. By contrast, the inner diameter of the tube is not precisely sized in the present invention, but only generally of the indicated diameter. The approach of the invention makes precise sizing of the entire inner diameter unnecessary, eliminating many of the steps described above. Improved manufacturability and increased yield are important advantages of the present invention.

An elongated tool is provided, numeral 42. FIGS. 5A–5F illustrate some operable types of tools 50, but the invention is not limited to the use of these tools. The tool 50 has a body 52 and, in the preferred case, three track-forming elements 54 extending outwardly from the body 52 equidistantly around the circumference of the body 52 (120 degrees, +/−0.2 degrees in the preferred form). The angular positioning of the track-forming elements 54 corresponds to the desired angular positioning of the tracks 30 in the final article. Symmetric positioning of the tracks 30 is normally desired, as illustrated for the preferred embodiment. However, if the desired angular positioning of the tracks 30 is either asymmetric or non-equiangular but symmetric, the track-forming elements 54 are positioned accordingly.

Figure 5A:
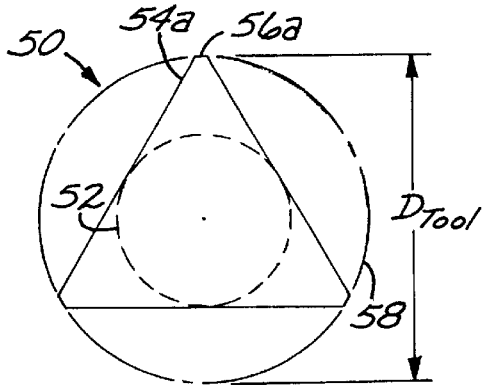
Figure 5B:
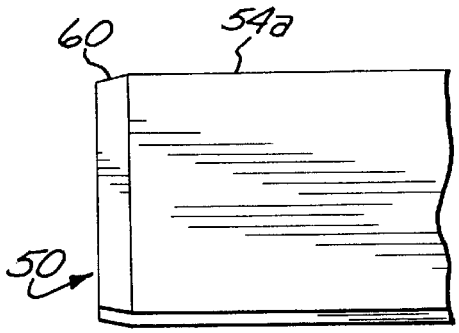
Figure 5C:
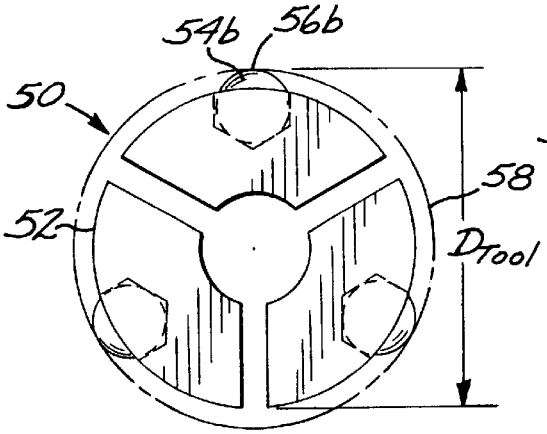
Figure 5D:
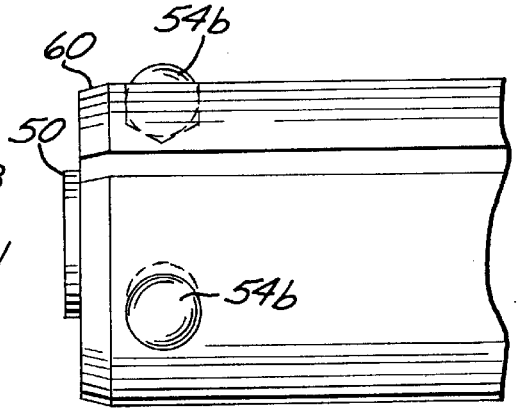
Figure 5E:
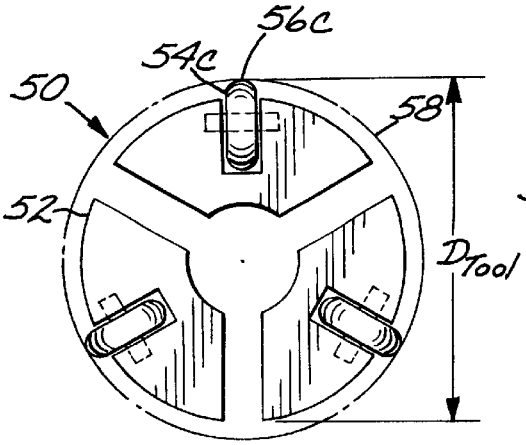
Figure 5F:
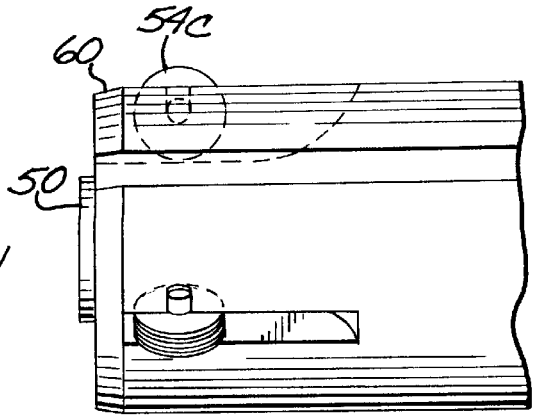

In the preferred embodiment of FIGS. 5A–5B, each track-forming element is a rigid arm 54*a*. A contact surface 56*a* of the arm 54*a* defines the shape of the bottom of the track 30, which is preferably either flat, or circular in cross section and concentric with the inner wall 32 of the tube barrel 22. In the embodiment of FIGS. 5C–5D, the track-forming element is a rolling ball 54*b*, and the contact surface 56*a* is curved with the radius of the ball 54*b*. In the embodiment of FIGS. 5E–5F, the track-forming element is a rolling wheel 54*c*, and the contact surface has a relatively small radius as defined by the side-to-side radius of the rolling wheel 54*c*.

In each of the tools such as those shown in FIGS. 5A–5F, the contact surfaces 56 of the tools 50 define a circumscribed circle 58 of diameter $D_{tool}$. The value of $D_{tool}$ is greater than that of $D_{tube}$ in each case, typically by an amount of from about 0.001 to about 0.002 inch. One half of this difference defines the depth of the tracks 30 in the final tube barrel 22.

The track-forming elements 54 are made of a material that is harder than the material of construction of the tube barrel 22. Preferably, the track-forming elements 54 are made of hardened tool steel for the case of a copper tube barrel 22. As necessary, even harder materials may be used for the track-forming elements.

Figure 6:
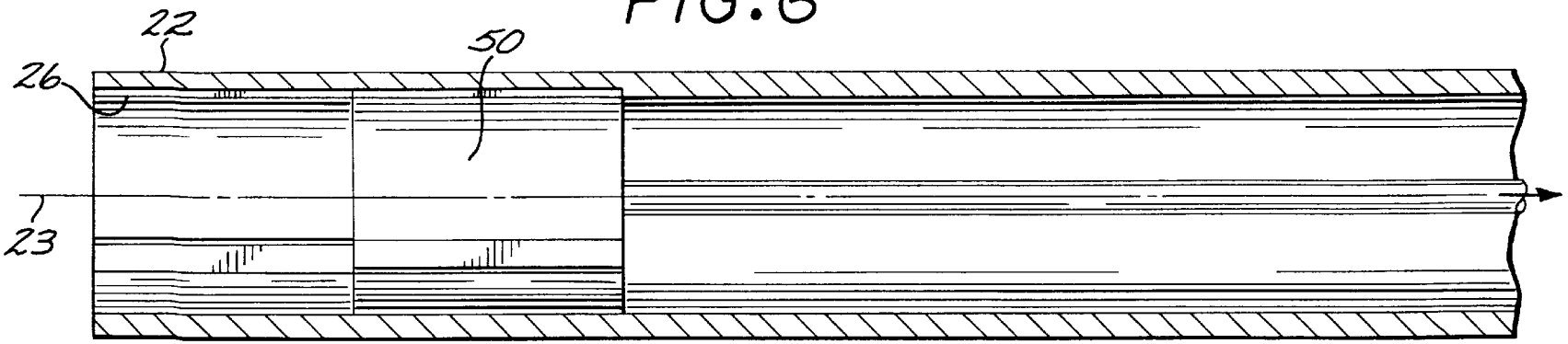
FIG. 6 is a schematic side sectional view of the tool being forced through the bore of the tube.

Returning to FIG. 4, the tool 50 is forced through the bore 26 of the traveling wave tube barrel 22 in the direction parallel to the longitudinal axis 23, numeral 44. FIG. 6 illustrates the tool 50 being pulled through the bore 26 of the tube barrel 22, but it may instead be pushed through the bore 26. The tool 50 is self-centering as it is forced through the bore 26. To allow the tool 50 to be inserted into the bore 26, the leading edge of the tool 50 may be beveled or tapered, as illustrated at numeral 60 in FIGS. 5B, 5D, and 5F. As the tool 50 moves through the bore 26, the track-forming elements 54 form the tracks 30 by metal deformation and displacement, rather than metal cutting, metal shaving, or the like. This mode of formation of the tracks 30 does not produce any debris that would require subsequent cleaning and might remain after cleaning to contaminate the final assembly 20. The forcing operation 44 may be performed with or without lubrication of the tool and the inner surface of the tube barrel 22. Forcing without lubrication is preferred, to avoid the introduction of a lubricant that would require subsequent cleaning. Initial tests indicate that unlubricated forcing 44 works well in many cases.

The tool 50 is preferably elongated parallel to the longitudinal axis 23, as shown in FIG. 6. This elongation serves to stabilize the tool 50 against circumferential rotation as it is pulled through the bore 26, much in the manner of the keel of a boat, producing long, straight tracks 30 parallel to the longitudinal axis 23. The tool of FIGS. 5A–5B is preferred for this reason, because the contact surface 56 may be given any desired shape, and because the sides of the tracks 30 are precisely defined by the shape of the side of the arm 54*a*. The tools of FIGS. 5C–5D and 5E–5F are operable but less preferred, because they tend to rotate circumferentially in the bore unless care is taken to prevent such rotation.

In some cases, the material of construction of the tube barrel 22 may prevent the formation of tracks 30 of the desired shape and depth, in a single pass of a single tool 50. Various factors may be changed to permit the tracks to be formed. A lubricant may be used. The temperature of the tube and the tool during the forcing operation 44 may be changed. It is preferred to performing the forcing operation 44 at room temperature, but the temperature of the tube and the tool may be reduced to a sub-room temperature, or increased to an elevated temperature, with a refrigerator or oven, respectively. In another approach, a series of tools 50 of increasing effective diameter may be used. For example, if the tube has an inner diameter of $D_{tube}$ and the bottom of the track is to have a final diameter of 1.010 $D_{tube}$, a first tool like those illustrated, and with a circumscribed diameter $D_{tool}$ of 1.005 $D_{tube}$ may be first forced through the bore tube to initially define the location and shape of the track. Thereafter, a second tool like those illustrated, and with a circumscribed diameter $D_{tool}$ of 1.010 $D_{tube}$ may be second forced through the bore of the tube, taking care that the second tool does not form new tracks, but instead only enlarges and deepens the existing tracks formed by the first tool. If even deeper tracks are required, more than two tools of increasing effective diameters may be used.

After the tracks 30 are formed, the traveling wave tube circuit assembly 24 is assembled into the interior of the tube barrel 22, with the rods 28 supported in the tracks 30, step 46 of FIG. 4. In the preferred approach, the rods 28 are first assembled together with the helix 34 to form the traveling wave tube circuit assembly 24. The tube barrel 22, with the previously formed tracks 30, is placed into an oven and heated, so that it expands radially. The traveling wave tube circuit assembly 24 (initially at lower temperature) is slid into the tube barrel 22 along the longitudinal axis 23 until it reaches the desired location. The tube barrel 22 and the traveling wave tube circuit assembly 24 are then removed from the oven and cooled, so that the tube barrel 22 contracts radially inwardly to capture the rods 28 within the tracks 30 by a shrink fitting approach. In a variation of this approach, the outer ends of the rods may initially be coated with a braze metal that is molten at the temperature to which the tube is first heated, and thereafter solidifies when the tube is cooled to bond the rods 28 firmly to the tracks 30.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A method of fabricating a traveling wave tube assembly, comprising the steps of providing a hollow cylindrical barrel having a longitudinal axis and having a bore defined by an inner wall with an inside diameter;

providing an elongated tool having a tool body, and at least two track-forming elements extending outwardly from the tool body, the at least two track-forming elements having a circumscribed maximum diameter greater than the inside diameter of the hollow cylindrical barrel;

forcing the tool through the bore in a direction parallel to the longitudinal axis to define a track in the inner wall of the hollow barrel for each of the at least two track-forming elements; and assembling a traveling wave tube circuit assembly inside the bore, the traveling wave tube circuit assembly including at least two rods, one supported in each of the at least two tracks and extending parallel to the longitudinal axis.

2. The method of claim 1, wherein the step of providing a hollow cylindrical barrel includes the step of providing a barrel having the inner wall made of copper.

3. The method of claim 1, wherein the step of providing an elongated tool includes the step of providing a track-forming element elongated parallel to a direction of elongation of the tool.

4. The method of claim 1, wherein the step of forcing the tool includes the step of pulling the tool through the bore.

5. The method of claim 1, wherein the step of forcing the tool includes the step of pushing the tool through the bore.

6. The method of claim 1, wherein the step of providing an elongated tool includes the step of providing an elongated tool having track-forming elements including roller elements.

7. The method of claim 1, wherein the step of providing an elongated tool includes the step of providing an elongated tool having rigid track-forming elements.

8. The method of claim 1, wherein the step of forcing is performed with the barrel at room temperature.

9. The method of claim 1, wherein the step of forcing is performed with the barrel at a temperature greater than room temperature.

10. The method of claim 1, wherein the step of forcing is performed with the barrel at a temperature below room temperature.

11. The method of claim 1, wherein the step of providing an elongated tool includes the steps of providing an elongated tool having three track forming elements arranged equidistantly around the tool body.

12. The method of claim 1, including the additional steps, after the step of forcing the tool and before the step of assembling a traveling wave tube circuit assembly, of providing a second elongated tool having a second tool body, and at least two second track-forming elements extending outwardly from the second tool body, the at least two second track-forming elements corresponding in circumferential position to the at least two track-forming elements, the at least two second track-forming elements having a second circumscribed maximum diameter greater than the circumscribed maximum diameter; and forcing the second tool through the bore in the direction parallel to the longitudinal axis to enlarge the tracks in the inner wall of the hollow barrel.

13. The method of claim 1, wherein the at least two track-forming elements are positioned symmetrically about the tool body.

14. A method of fabricating a traveling wave tube assembly, comprising the steps of providing a hollow cylindrical barrel having a longitudinal axis and having a bore defined by an inner wall with an inside diameter;

providing a first elongated tool having a first tool body, and at least two first track-forming elements extending outwardly from the first tool body and elongated parallel to a direction of elongation of the tool, the at least two first track-forming elements having a first circumscribed maximum diameter greater than the inside diameter of the hollow cylindrical barrel;

forcing the first tool through the bore in a direction parallel to the longitudinal axis to define a track in the inner wall of the hollow barrel for each of the at least two first track-forming elements;

providing a second elongated tool having a second tool body, and at least two second track-forming elements extending outwardly from the second tool body, the at least two second track-forming elements corresponding in circumferential position to the at least two first track-forming elements, the at least two second track-forming elements having a second circumscribed maximum diameter greater than the first circumscribed maximum diameter;

forcing the second tool through the bore in the direction parallel to the longitudinal axis to enlarge the tracks in the inner wall of the hollow barrel; and assembling a traveling wave tube circuit assembly inside the bore, the traveling wave tube circuit assembly including at least two rods, one supported in each of the at least two tracks and extending parallel to the longitudinal axis.

15. The method of claim 14, wherein the at least two track-forming elements are positioned symmetrically about the tool body.

* * * * *